US005361605A

United States Patent [19]

Pizzi et al.

[11] Patent Number: 5,361,605

[45] Date of Patent: Nov. 8, 1994

[54] BEVERAGE KEG INSULATED COOLING JACKET

[76] Inventors: Joseph A. Pizzi, 4620 Greenhill St., Cocoa, Fla. 32927-3522; Jeffrey G. Snyder, 1712 Orange Hill Way, Brandon, Fla. 33510

[21] Appl. No.: 208,313

[22] Filed: Mar. 10, 1994

[51] Int. Cl.[5] ..... F25D 3/08

[52] U.S. Cl. ..... 62/530; 62/372; 62/457.4; 220/903

[58] Field of Search ..... 62/457.1, 457.2, 457.3, 62/457.4, 457.7, 530, 529, 371, 372; 220/903, 737, 740, 6, 7; 607/97, 114

[56] References Cited

U.S. PATENT DOCUMENTS 3,443,397 5/1969 Donovan et al. ..... 62/457.1
4,481,791 11/1984 German .
4,483,157 11/1984 Human .
4,514,993 5/1985 Johnson .
4,653,290 3/1987 Byrne .
4,802,344 2/1989 Livingston et al. ..... 62/457.2
4,963,175 10/1990 Pace .

*Primary Examiner*—John M. Sollecito

[57] ABSTRACT

A flexible wrap is arranged for securement about the side wall portion of a beverage keg, wherein the wrap includes a row of parallel pockets extending from the sides of the beverage keg to accommodate gel packs containing a freezable gel therewithin. The wrap is arranged for securement about the beverage keg, and further employs a lid and floor arranged to overlie the top and bottom walls of an associated beverage keg.

2 Claims, 3 Drawing Sheets

BEVERAGE KEG INSULATED COOLING JACKET

BACKGROUND OF THE INVENTION

1. Field of the Invention

The field of invention relates to beverage cooling structure, and more particularly pertains to a new beverage keg cooling arrangement wherein the same is directed to provide a covering web structure to enclose a beverage keg to effect and preserve its cooling.

2. Description of the Prior Art

Typical beverage cooling is effected by placing a beverage keg within a tub, and subsequently placing a quantity of ice therewithin, in a manner as indicated in U.S. Pat. No. 4,963,175.

The use of cold pack structure for beverage kegs is indicated in prior art U.S. Pat. No. 4,483,157. In this device, refrigerant cases are mounted to upper and lower portions of the housing of the structure.

U.S. Pat. No. 4,514,993 indicates a barrel core defining an insulating jacket to be positioned about the side walls of an associated keg structure and the like, wherein the jacket structure includes pockets to receive plastic bags to be filled with water.

The instant invention attempts to overcome deficiencies of the prior art by providing for a jacket structure which includes a lid and floor to enclose an associated beverage keg and to this extent, the present invention substantially fulfills this need.

SUMMARY OF THE INVENTION

In view of the disadvantages inherent in the known types of beverage keg cooling apparatus now present in the prior art, the present invention provides a beverage keg cooling arrangement wherein the same is directed to a flexible jacket including a lid and floor which may be utilized to enclose a beverage keg. As such, the general purpose of the present invention, which will be described subsequently in greater detail, is to provide a new beverage keg cooling arrangement apparatus and method which has many of the advantages of the prior art listed heretofore and many novel features that result in an beverage keg cooling arrangement apparatus which is not anticipated, rendered obvious, suggested, or even implied by any of the prior art, either alone or in any combination thereof.

To attain this, the present invention provides a flexible wrap arranged for securement about the side wall portion of a beverage keg, wherein the wrap includes a row of parallel pockets extending from the sides of the beverage keg to accommodate gel packs containing a freezable gel therewithin. The wrap is arranged for securement about the beverage keg, and further employs a lid and floor arranged to overlie the top and bottom walls of an associated beverage keg.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage keg cooling arrangement apparatus and method which has many of the advantages of the prior art listed heretofore and many novel features that result in a beverage keg cooling arrangement apparatus which is not anticipated, rendered obvious, suggested, or even implied by any of the prior art, either alone or in any combination thereof.

It is another object of the present invention to provide a new beverage keg cooling arrangement which may be easily and efficiently manufactured and marketed.

It is a further object of the ;present invention to provide a new beverage keg cooling arrangement which is of a durable and reliable construction.

An even further object of the present invention is to provide a new beverage keg cooling arrangement which is susceptible of a low cost of manufacture with regard to both materials and labor, and which accordingly is then susceptible of low prices of sale to the consuming public, thereby making such beverage keg cooling arrangements economically available to the buying public.

Still yet another object of the present invention is to provide a new beverage keg cooling arrangement which provides in the apparatuses and methods of the prior art some of the advantages thereof, while simultaneously overcoming some of the disadvantages normally associated therewith.

It is a further object of the present invention to provide a new beverage keg cooling arrangement comprising a flexible wrap arranged for securement about the side wall portion of a beverage keg, wherein the wrap includes a row of parallel pockets extending from the sides of the beverage keg to accommodate gel packs containing a freezable gel therewithin.

Yet still another object of the present invention to provide a new beverage keg cooling arrangement which comprises flexible wrap arranged for securement about the side wall portion of a beverage keg, wherein the wrap further employs a lid and floor arranged to overlie the top and bottom walls of an associated beverage keg.

These together with other along with the various features of novelty which characterize the invention, are pointed out with particularity in the claims annexed to and forming a part of this disclosure. For a better understanding of the advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
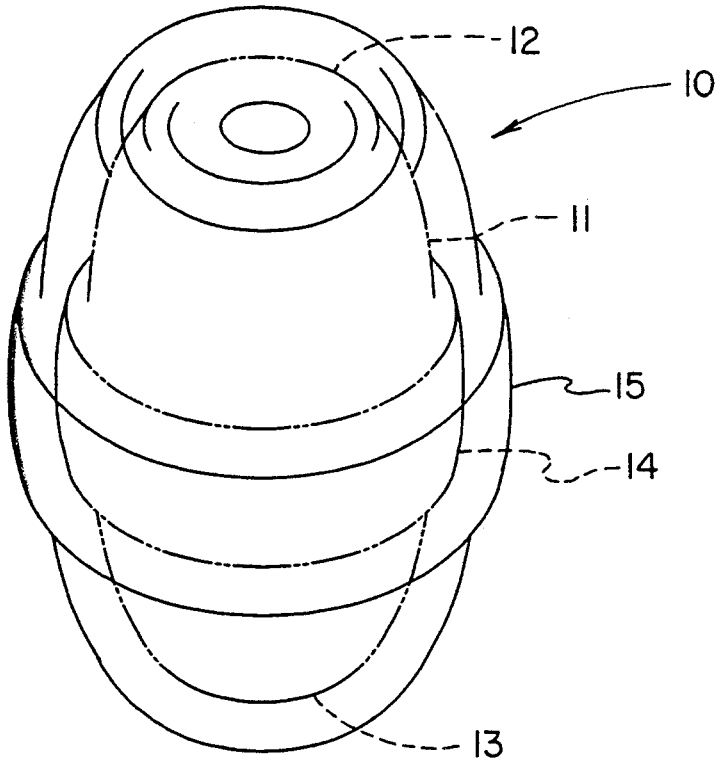
FIG. 1 is an isometric illustration of the invention installed upon a keg.
Figure 2:
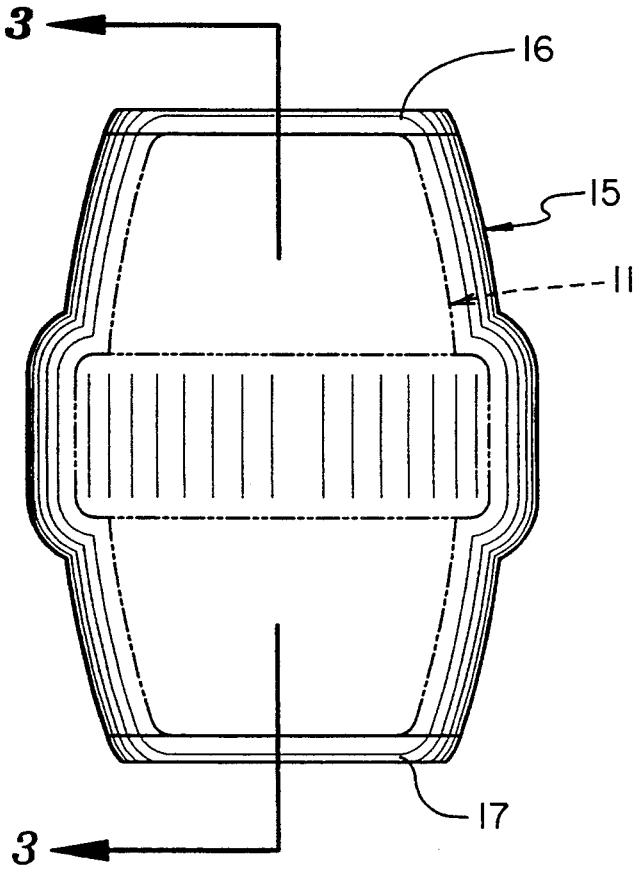
FIG. 2 is a side elevational view of the invention.

With reference now to the drawings, and in particular to FIGS. 1–5 thereof, a new beverage keg cooling arrangement embodying the principles and concepts of the present invention and generally designated by the reference numeral 10 will be described.

More specifically, the beverage keg cooling arrangement 10 of the instant invention may be utilized with a beverage keg 11 having a keg top wall 12 spaced from a keg bottom wall 13, with a keg side wall 14 extending therearound. The beverage keg cooling arrangement 10 comprises a flexible wrap 15 shaped so as extend coextensively of the side wall 14, as best illustrated in FIG. 1.

Figure 3:
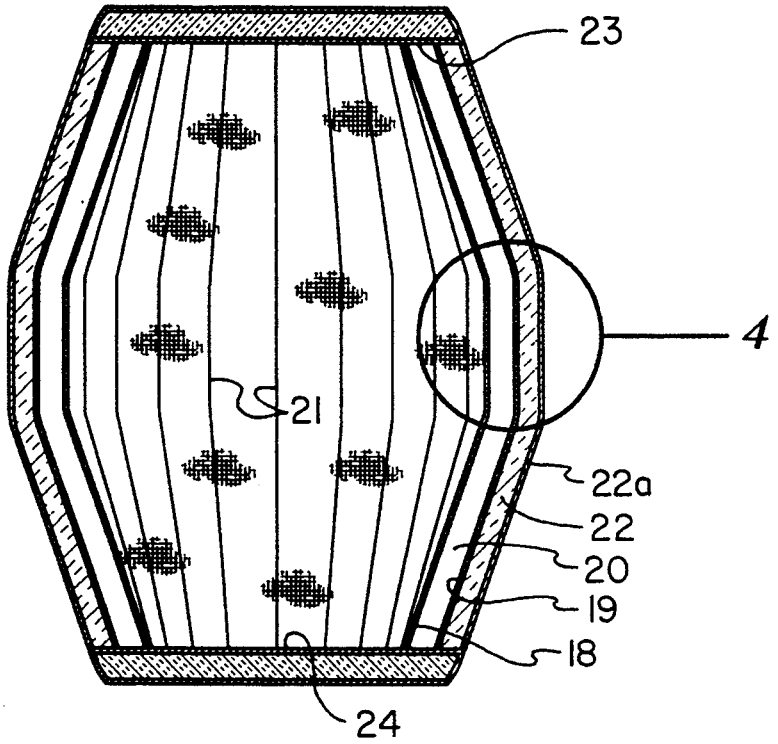
FIG. 3 is a cross sectional illustration of the invention as indicated by the line 3—3 of FIG. 2.
Figure 4:
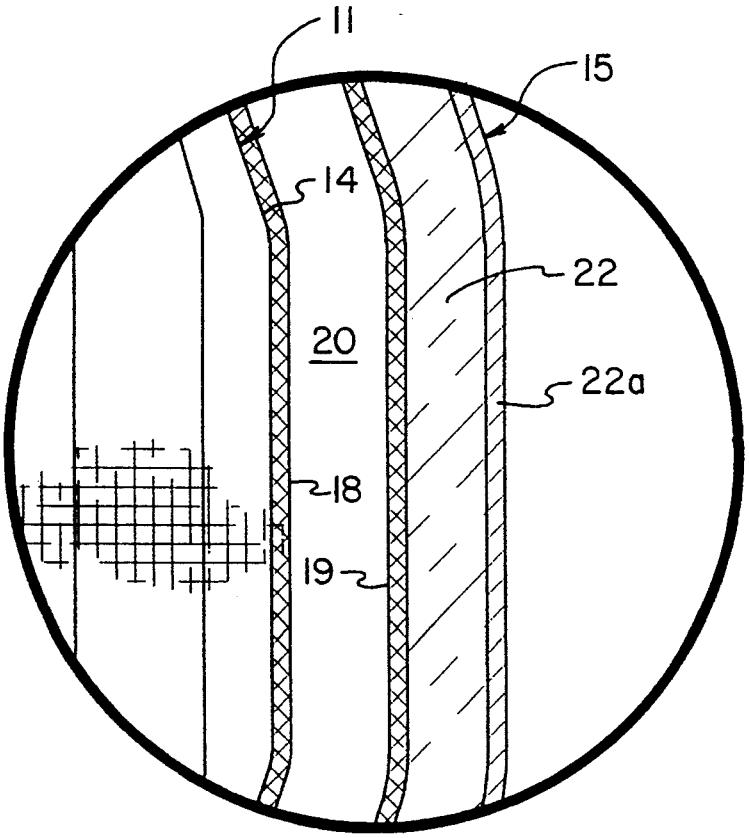
FIG. 4 is an enlarged view of the circled area set forth in section 4 of FIG. 3.
Figure 5:
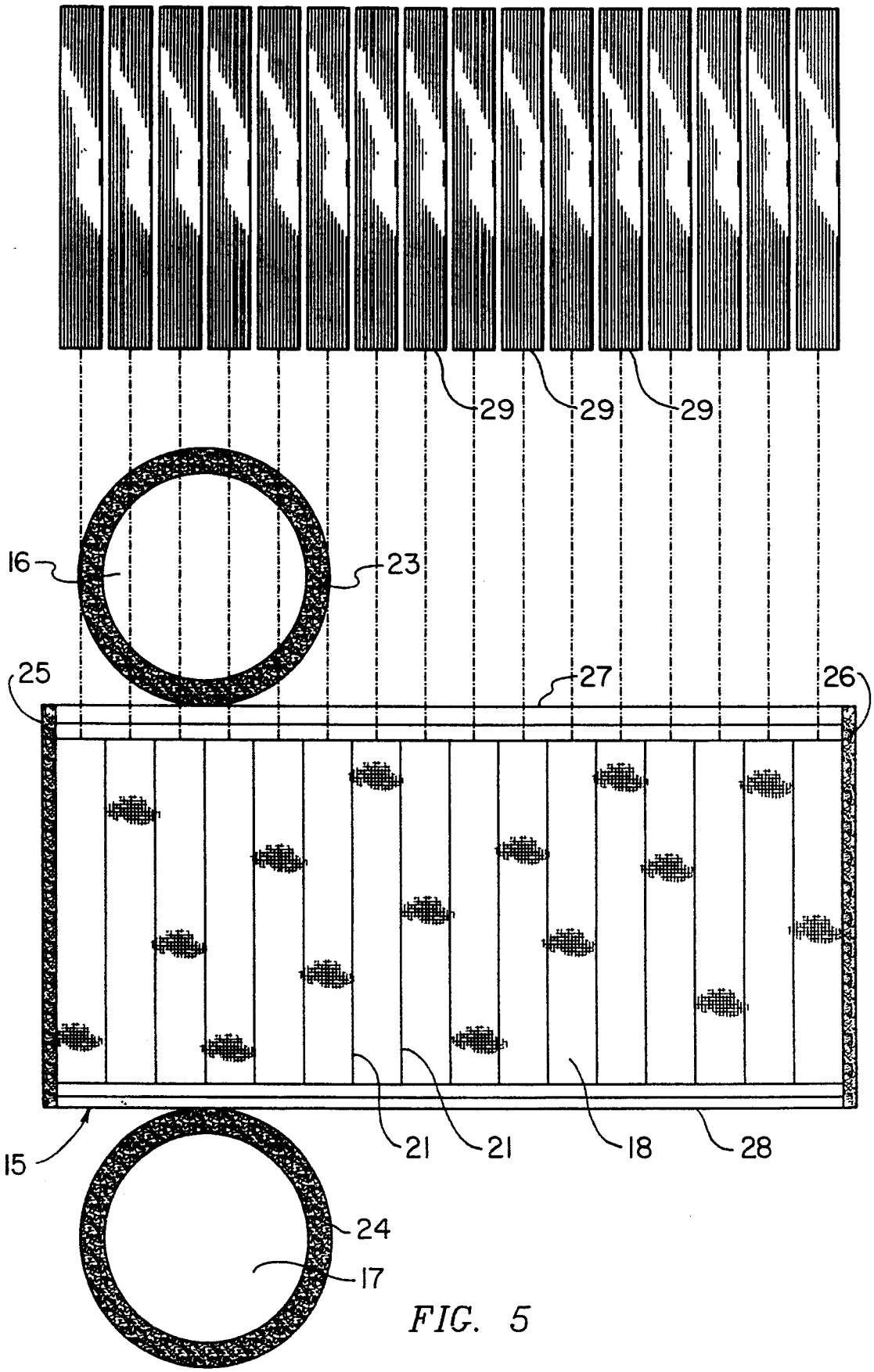
FIG. 5 is an orthographic exploded view indicating the jacket with the associated lid, floor, and cooling packages arranged for assembly to the jacket.

With reference now to FIGS. 3,4 and 5, it can be shown that the flexible wrap 15 includes first and second side strips 25 and 26 formed of cooperative hook and loop material which cooperate to permit securement of the wrap about the keg side wall 14. The wrap 15 includes a fibrous fluid absorbent inner layer 18 (see FIGS. 3 and 4)spaced from a fibrous fluid absorbent outer layer 19 to permit absorption of moisture relative to the inner and outer layers. Seams 21 arranged in a parallel relationship relative to one another extend parallel between the first and second side strips 25 and 26 defining chamber pockets 20 between adjacent seams 21.

Each of the chamber pockets 20 is arranged to receive an individual cooling gel filled container 29 of flexible construction, as indicated in the FIG. 5. Positioned in adjacency to the outer layer 19 is a flexible polymeric foam insulation layer 22 coextensive with the outer layer 19, with fluid impermeable exterior layer 22*a* arranged to contain moisture and the like within the wrap structure when secured about the keg 11.

The beverage keg cooling arrangement 10 includes a lid 16, as well as a floor 17. The lid and the floor 16 and 17, respectively, are formed of a polymeric foam type insulative material and include respective first and second annular hook and loop layers 23 and 24 mounted thereto for securement to hook and loop top and bottom side strips 27 and 28, respectively, of the flexible wrap 15.

As to the manner of usage and operation of invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage keg cooling arrangement for securement about a beverage keg, wherein the beverage keg includes a keg top wall spaced from a keg bottom wall, and a keg side wall extending therearound, said arrangement comprising:

a flexible wrap, the flexible wrap including a hook and loop fastener first side strip spaced from a hook and loop fastener second side strip, a hook and loop fastener top side strip and a hook and loop fastener bottom side strip, with the flexible wrap including a fibrous fluid absorbent inner layer spaced from a fibrous fluid absorbent outer layer, a flexible polymeric foam insulative layer coextensive with the outer layer, a fluid impermeable exterior layer mounted coextensively with the insulative layer spaced from the outer layer, and a plurality of parallel seams directed through the inner layer, the outer layer, the insulative layer, and the exterior layer to define a plurality of parallel chamber pockets between the inner layer and the outer layer, and, a plurality of flexible refrigerant containers, wherein each of said chamber pockets define means to receive an individual one of said flexible refrigerant containers.

2. The cooling arrangement as set forth in claim 1, and further including a polymeric foam lid, said lid having a lid hook and loop fastener layer, wherein the hook and loop fastener layer is arranged for securement to the hook and loop top side strip of the flexible wrap; and a polymeric foam floor having a floor hook and loop fastener layer arranged for securement to the hook and loop fastener bottom side strip of the flexible wrap, wherein the lid is arranged for positioning onto the keg top wall and the floor is arranged for positioning against the keg bottom wall.

* * * * *